United States Patent [19]

Takagi et al.

[11] Patent Number: 5,031,580

[45] Date of Patent: Jul. 16, 1991

[54] OIL LUBRICATING AND COOLING SYSTEM FOR ENGINES

[75] Inventors: Masahiro Takagi, Yoshizawa; Hiroshi Moritake, Shizuoka, both of Japan

[73] Assignee: Suzuki Jidosha Kogyo Kabushiki Kaisha, Japan

[21] Appl. No.: 510,159

[22] Filed: Apr. 16, 1990

[30] Foreign Application Priority Data

Apr. 18, 1989 [JP] Japan ..... 1-44498[U]
Nov. 24, 1989 [JP] Japan ..... 1-303169

[51] Int. Cl.[5] ..... F01P 3/00

[52] U.S. Cl. ..... 123/41.42; 123/41.57; 123/196 R; 184/6.13; 184/104.2

[58] Field of Search ..... 123/41.42, 41.57, 41.33, 123/196 R, 196 AB; 184/104.2, 104.3, 6.13, 6.23; 180/229

[56] References Cited

U.S. PATENT DOCUMENTS 3,945,463 3/1976 Okano et al. ..... 184/6.13
4,681,189 7/1987 Krisiloff ..... 184/6.13

FOREIGN PATENT DOCUMENTS 282109 12/1987 Japan ..... 123/41.33
1379471 3/1988 U.S.S.R. ..... 123/41.57

*Primary Examiner*—Noah P. Kamen
*Attorney, Agent, or Firm*—Bruce L. Adams; Van C. Wilks

[57] ABSTRACT

An engine unit is equipped with a cylinder head and a crank case in which an oil feed pump and a scavenge pump are disposed. A lubricating and cooling system for the engine unit comprises an oil tank constituted by a hollow main tube, a hollow down tube, a hollow bridge tube connecting the main tube and the down tube so as to communicate with each other through oil ports and frame members covering a space defined by the respective tubes. A feed pipe connects the down tube to the feed pump, a scavenge pipe connects the oil tank to the scavenge pump, and a flowout pipe directly or indirectly connects the cylinder head to the oil tank. The oil pots formed in the main tube, the down tube and the bridge tube have opening sizes selected to effectively separate air from the engine oil during the circulation thereof.

13 Claims, 5 Drawing Sheets

OIL LUBRICATING AND COOLING SYSTEM FOR ENGINES

BACKGROUND OF THE INVENTION

The present invention relates to a cooling system for cooling an engine by circulating an engine oil and, more particularly, to a cooling system for cooling a four-cycle engine utilizing an oil tank device having an improved air bleeding structure.

In a conventional four-cycle engine of a motorcycle, for example, an engine oil is circulated through an oil tank device as a cooling medium for cooling the engine as well as lubricating the same. In the conventional engine cooling system, the engine oil is forciblY supplied to a cylinder head of the engine to cool the cylinder head at which the engine is most highly heated, and the engine oil after the utilization for cooling the cylinder head is returned to an oil pan in a crank case or a clutch chamber through a return pipe or return passage in a cylinder block.

Usually, in the conventional engine cooling system described above, there is a fear of agitating the engine oil returned to the oil pan because of the arrangement of a number of rotating members such as gears and crank shaft and, hence, increasing the temperature of the engine oil, resulting in the degradation of the engine oil. Furthermore, in this connection, there is also a fear that the rotating members will agitate a voluminous amount of the engine oil in the oil pan, resulting in the mechanical loss of the rotating members.

In a conventional motorcycle, the engine cooling system utilizing an oil tank device is composed by combining a hollow main tube, a hollow downtube, a hollow tension tube, and the like for circulating the engine oil, for example, as described in the Japanese Patent Publication Nos. 5130/1977 and 5131/1977. In another type of conventional motorcycle, there is provided a frame member having an inner hollow portion which is utilized as an oil tank.

However, with these oil tank devices, voluminous air is contained in the engine oil introduced from the oil pump into the oil tank. The engine oil together with the air is again circulated in the oil pan of the engine, resulting in the problem of inadequate engine lubrication and hence degrading the cooling function of the engine. No positive means for bleeding the air from the engine oil has heretofore been provided for the oil tank device of the type described above. In order to obviate these defects, there is also provided an oil tank device of a motorcycle in which the engine oil including the air is circulated through a long passage formed by a pipe structure of the frame of the motorcycle and the air is bled during the circulation.

With the construction of the oil tank described above, however, it is impossible to completely eliminate or bleed the air from the engine oil. The inclusion of the air in the engine oil may cause the mechanical loss of components of the engine unit such as the crank shaft, generate noise and make instable the pressure, the temperature and the circulation of the engine oil, which may finally result in an over-heat condition, the seizing of the engine and the lowering of the durability of the engine components as well as the degradation of the engine cooling function.

SUMMARY OF THE INVENTION

An object of the present invention is to substantially eliminate defects or drawbacks encountered in the prior art technology and to provide an engine cooling system of a motorcycle capable of improving the engine cooling efficiency and preventing the engine oil from being degraded and improving mechanical loss of components arranged in a cylinder unit of the motorcycle.

Another object of the present invention is to provide an engine cooling system utilizing an oil tank device capable of improving the circulation of the engine oil including substantially no air and improving the mechanical loss of the engine components.

These and other objects can be achieved according to the present invention in one aspect by providing a cooling system for cooling an engine unit equipped with a cylinder head and a crank case in which an oil feed pump and a scavenge pump are disposed, the cooling system comprising an oil tank, a drysump type oil lubrication unit in which a part of the engine oil in the oil tank is fed into components of the engine unit for lubricating the same and the engine oil after the lubrication and dropped in the crank case is again fed in the oil tank by means of the scavenge pump, a pipe means for feeding the reminder of the engine oil to the cylinder head as cooling oil by means of the feed pump, and a pipe means for feeding the engine oil after the cooling of the cylinder head into the oil tank.

In another aspect of the present invention, there is provided a cooling system for cooling an engine unit equipped with a cylinder head and a crank case in which an oil feed pump and a scavenge pump are disposed, the cooling system comprising an oil tank constituted by a hollow main tube, a hollow down tube, a hollow bridge tube connecting the main tube and the down tube so as to communicate with each other through port means, and frame members covering a space defined by the main tube, the down tube and the bridge tube, a feed pipe connecting the down tube to the feed pump, a scavenge pipe connecting the oil tank to the scavenge pump, and a flowout pipe directly or indirectly connecting the cylinder head to the oil tank.

According to the cooling system of the type described above, the engine oil after cooling the cylinder head is directly or indirectly returned in the oil tank through the scavenge pipe, whereby an amount of the engine oil to be dropped in the crank case is substantially reduced and, hence, the engine oil is not significantly agitated in the crank case, thus reducing an increase in temperature of the engine oil in the crank case and preventing degradation of the engine oil as well as the mechanical loss of the engine components. An improved engine cooling function can be also attained.

In a further aspect according to the present invention, there is provided a cooling system for cooling an engine unit including an oil tank device, the oil tank device comprising, a head pipe, a hollow main tube extending downwardly from the head pipe, a hollow down tube extending downwardly from the head pipe, a hollow bridge tube connecting the main tube and the down tube, and frame members covering a space defined by the head pipe, the main tube, the down tube and the bridge tube, the main tube being provided with a first oil port communicating an interior of the main tube with an interior of the bridge tube, the down tube being provided with a second oil port communicating the interior cf the bridge tube with an interior of the down tube, the first oil port having an opening size larger than that of the second oil port, the main tube being further provided with an oil port communicating the interior of the main tube with the space, the down tube being further provided with an oil port communicating the interior of the down tube with the space, the bridge tube being provided with an oil port communicating the interior of the bridge tube with the space.

According to the cooling system of the type described above, the engine oil introduced into the main tube is then fed into the bridge tube through the first port having a reduced opening, thus air contained in the engine oil is effectively separated from the engine oil. The engine oil fed into the bridge tube is then fed into the down tube through the second port having a reduced opening. The first port has an opening size larger than that of the second port, so that the air separation effect can be further improved during the stay of the engine oil in the bridge tube. The air stored in the bridge tube flows into the space as an oil tank space through the port formed in the bridge tube. In the oil tank space, the air remaining in the engine oil is substantially separated from the engine oil during the stay in the oil tank space, whereby the engine oil containing substantially no air is supplied in the cylinder head of the engine unit, thus improving the performance of the engine oil as well as improving the engine cooling effect without causing the mechanical loss of the components of the engine unit.

BRIEF DESCRIPTION OF THE DRAWINGS

For a better understanding of the present invention and to show how the same may be carried into effect, reference will now be made, by way of preferred embodiments, to the accompanying drawings, in which.

DESCRIPTION OF THE PREFERRED EMBODIMENTS

Figure 1:
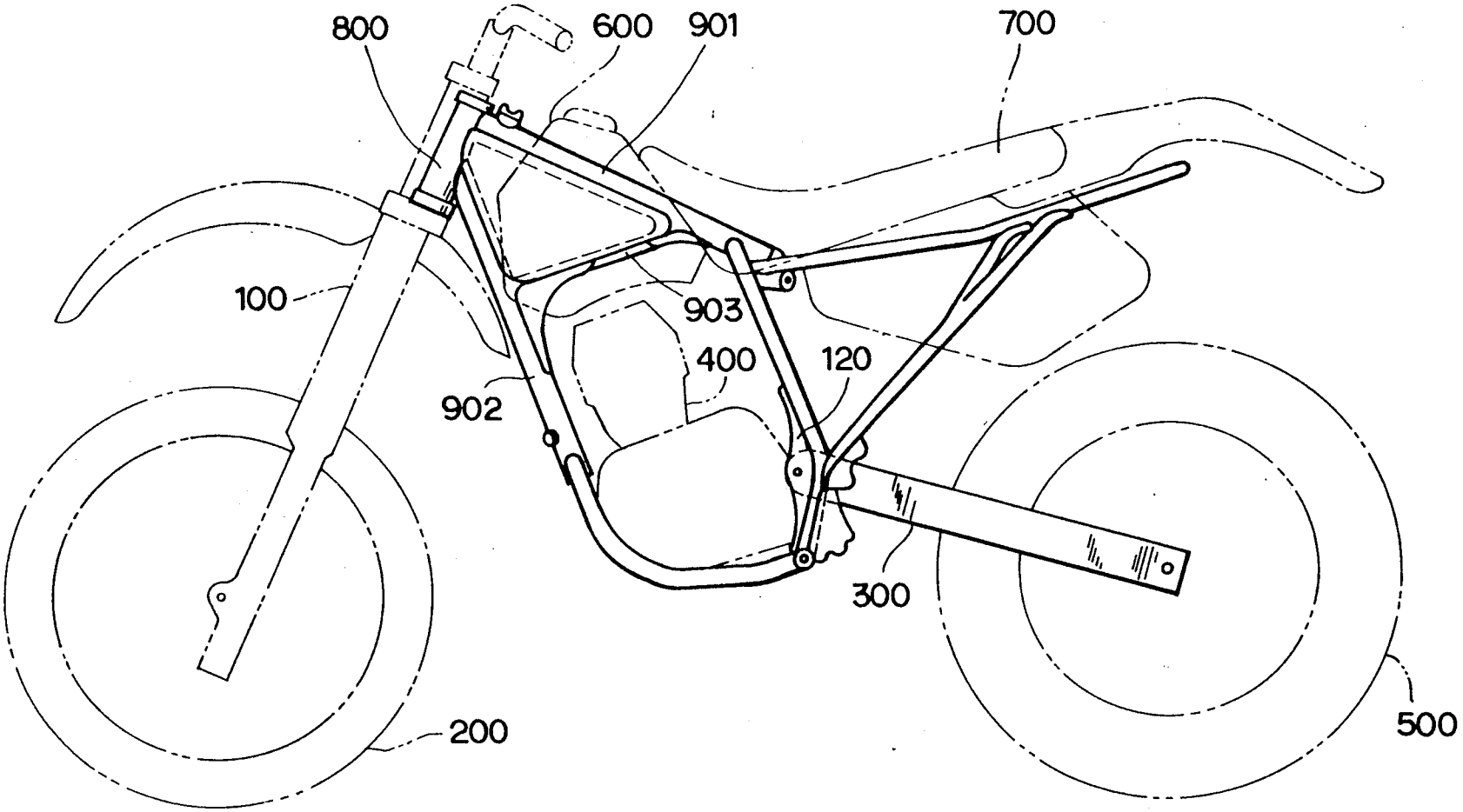
FIG. 1 is a side view of a motorcycle to which the present invention is applicable.

FIG. 1 is a side view of a motorcycle to which an engine cooling system mainly composed of an oil tank device according to the present invention is arranged.

Referring to FIG. 1, a front wheel 200 is rotatably supported by a front fork 100 at a front portion of a motorcycle body and a rear wheel 500 is supported vertically swingably by a swing arm 300 at a rear portion of the motorcycle body. An engine unit 400 is arranged at substantially the central portion of the motorcycle body below a fuel tank 600 disposed between a seat 700 for a rider and a head pipe 800. A main tube 901 extends obliquely rearwardly from the head pipe 800 and a down tube 902 also extends from the head pipe 800 downwardly. The main tube 901 and the down tube 902 are mutually connected through a bridge tube 903 and a space defined by the main tube 901, the down tube 902 and the bridge tube 903 constitutes an oil tank space by covering the space by a pair of side frame members.

Figure 2:
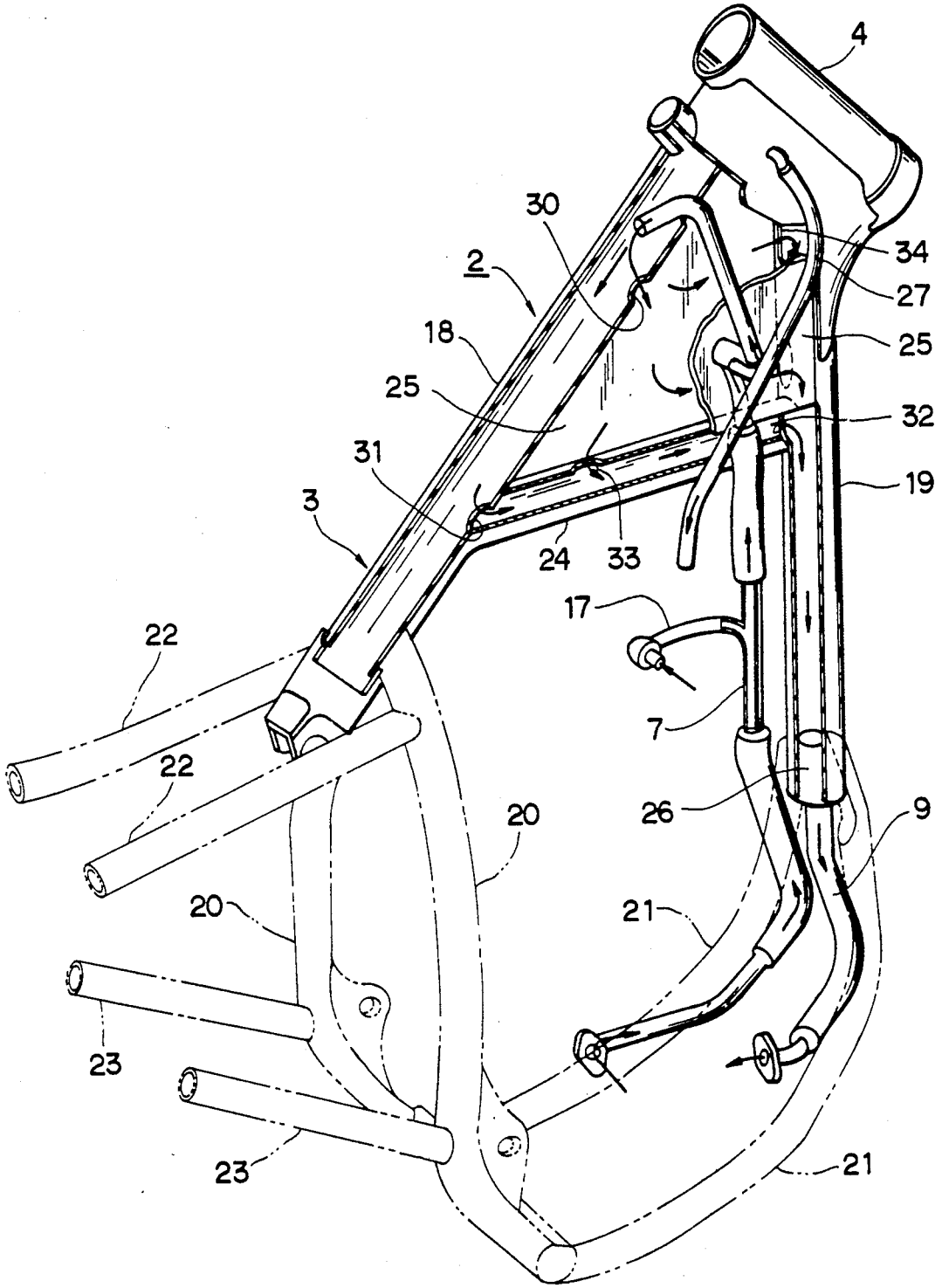
FIG. 2 is a perspective view of one embodiment of an engine cooling system utilizing an oil tank device of a motorcycle according to the present invention.
Figure 3:
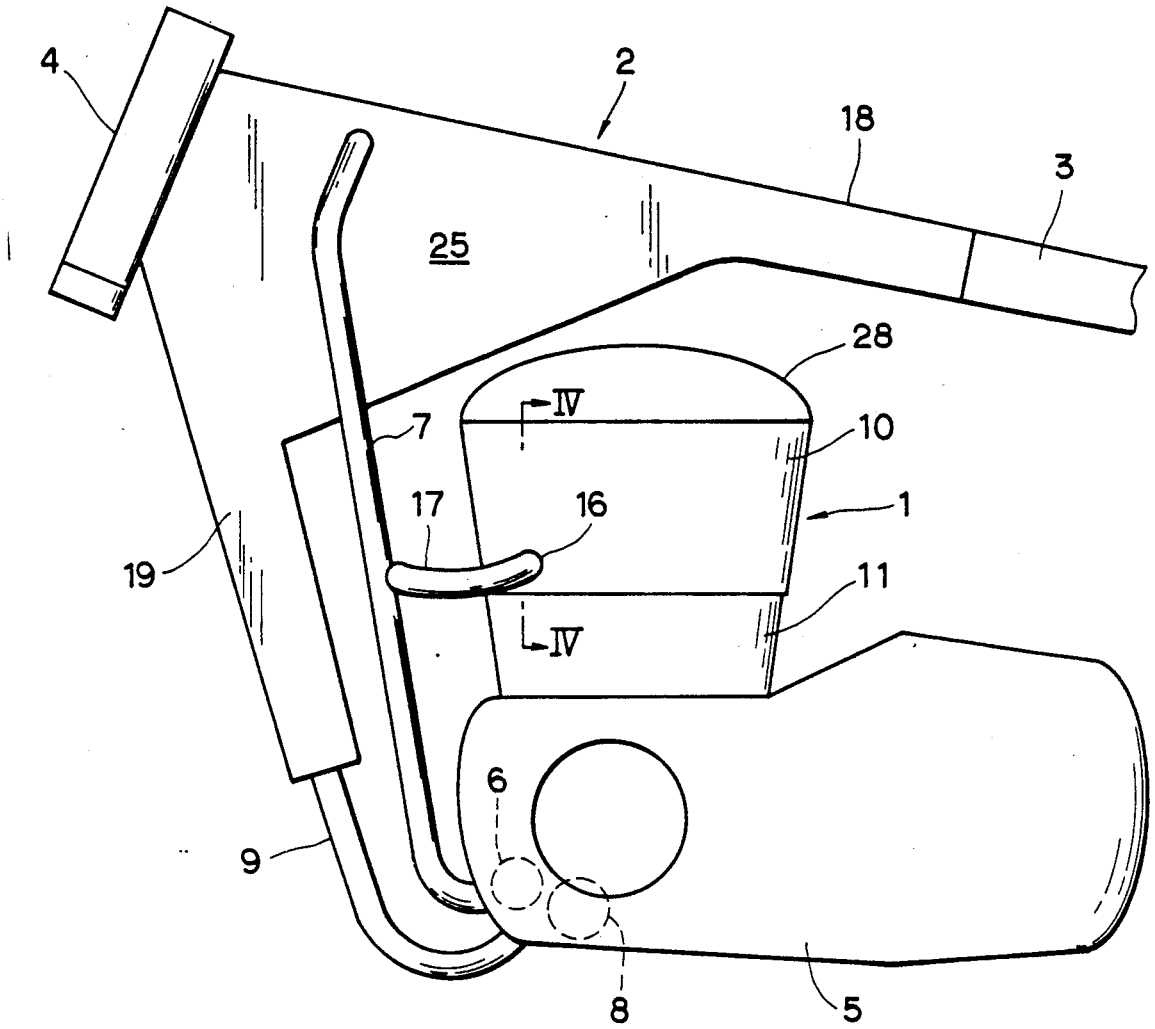
FIG. 3 is a brief side view of an engine unit and the engine cooling system shown in FIG. 2.

FIG. 2 is a detailed perspective view on an enlarged scale of the arrangement of the tube members shown in FIG. 1 constituting an engine cooling system according to the present invention and FIG. 3 is a side view of the arrangement of FIG. 1 including a four-cycle engine unit.

The lubrication for the engine unit 1 shown in FIG. 3 is carried out on the basis of a drysump lubrication system provided with an oil tank 2, which is arranged in association with a head pipe 4 of a body frame 3 of a motorcycle.

The oil lubrication of the drysump lubrication system is carried out in the following manner.

An engine oil contained in an oil pan, not shown, in a crank case 5 is circulated in the oil tank 2 through a scavenge pipe 7 by means of a scavenge pump 6 and stored in the oil tank 2. The oil stored in the oil tank 2 is fed by means of a feed pump 8 to respective components of the engine unit such as piston and cam shaft through a feed pipe 9 to thereby lubricate them. According to this embodiment, as described above, the oil pump 8 acts to feed a part of the engine oil in the oil tank 2 as lubricating oil and to feed the reminder of the engine oil to a cylinder head 10 of the engine to positively cool the cylinder head 10.

Figure 4:
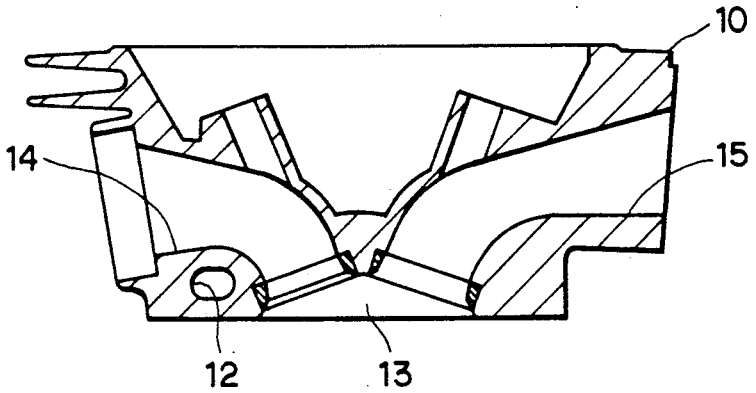
FIG. 4 is a sectional view taken along the line IV—IV of FIG. 3.

The engine oil for cooling the cylinder head 10 is fed into an oil passage 12 shown in FIG. 4 through a hole for inserting a stud bolt, not shown, for securing the cylinder head 10 to a cylinder block 11. The cylinder head 10 is provided with a combustion chamber 13, an exhaust port 14 and an intake port 15, both ports being communicated with the combustion chamber 13. The oil passage 12 is positioned below the exhaust port 14. The oil passage 12 is provided with an oil flowout port 16 on one side, left side as viewed in FIG. 3, of the cylinder block 11 (i.e. cylinder head 10). To the flowout port 16 is fitted a flowout pipe 17 at one end and the other end thereof is connected to the scavenge pipe 7. According to this structure, the engine oil passing through oil passage 12 and cooling the peripheral portions of the combustion chamber 13 and the exhaust port 14 flows into the scavenge pipe 7 through the flowout port 16 and the flowout pipe 17. Thereafter, the engine oil for cooling is combined with the engine oil passing the scavenge pipe 7 under pressure by means of the scavenge pump 6 and then fed into the oil tank 2.

The structure of the engine cooling system utilizing an oil tank device and the flow of the engine oil will be described in detail with reference to FIG. 2.

The body frame 3 includes a head pipe 4 having an upper portion to which a hollow main tube 18 is connected so as to extend downwardly and a lower portion to which a down tube 19 is connected so as to extend downwardly. The main tube 18 may have a structure acting as a tank rail for a fuel tank. A pair of body tubes 20 are connected to a lower portion of the main tube 18 so as to extend downwardly and a pair of lower tubes 21 are connected to a lower portion of the down tube 19. The body tubes 20 are connected to the lower tubes 21, respectively, whereby a space is defined by the main tube 18, the down tube 19, the body tubes 20 and the lower tubes 21, the space being utilized for a space into which the engine unit 1 is arranged. A pair of seat rails 22 are connected to the upper portions of the body tubes 20 and a pair of side tubes 23 are also connected to the lower portions of the body tubes 20, both the tubes 22 and 23 extending rearwardly, leftwardly as viewed in FIG. 1, of the motorcycle body.

A bridge tube 24 is connected between intermediate portions of the main tube 18 and the down tube 19 so as to reinforce these members. Both bilaterial sides of the main tube 18, the down tube 19 and the bridge tube 24 in the assembled condition are covered by plate-like tank frame members 25 so as to define a space therebetween which constitutes an oil tank 2. The upper end of the scavenge pipe 7 extends upwardly into an inner space of the upper portion of the main tube 18. The inner hollow portion of the main tube 18 ends at a portion slightly below the connection to the bridge tube 24.

According to the described construction, the engine oil in the scavenge pipe 7 first flows in the main tube 18 and then into the oil tank 2 through a port 30 or into the bridge tube 24 through a port 31. The engine oil flows through the oil tank 2 into the down tube 19 through a port 33 formed in the bridge tube 24 or a port 34 formed in the down tube 19 and the engine oil also flows through the bridge tube 24 into the down tube 19 through a port 32. The engine oil passes a strainer 26 and is then fed into the feed pump 8 disposed in the crank case 5 through the feed pipe 9. Thereafter, the engine oil is fed into the cylinder head 10 by the actuation of the feed pump 8 to cool the same and the engine oil after cooling the cylinder head 10 flows into the scavenge pipe 7 through a flowout pipe 17. The engine oil for cooling is then mixed with the engine oil for lubrication and the mixed engine oil is again fed into the main tube 18. A cylinder head 10 is covered by a cylinder head cover 28 (FIG. 3) to which the engine oil is fed through an overflow pipe 27.

As described above, the engine oil after cooling the cylinder head 10 can be fed into the oil tank 2 through the flowout pipe 17 and the scavenge pipe 7, so that an amount of the engine oil naturally dropping into the oil pan in the crank case 5 can be substantially reduced, thus reducing the agitation of the engine oil in the crank case 5 by the rotating members such as the crank shaft arranged in the crank case 5 and, hence, preventing the temperature of the engine oil from undesiredly increasing and also preventing the engine oil from being degraded. The mechanical loss of the rotating members can be also reduced.

Figure 5:
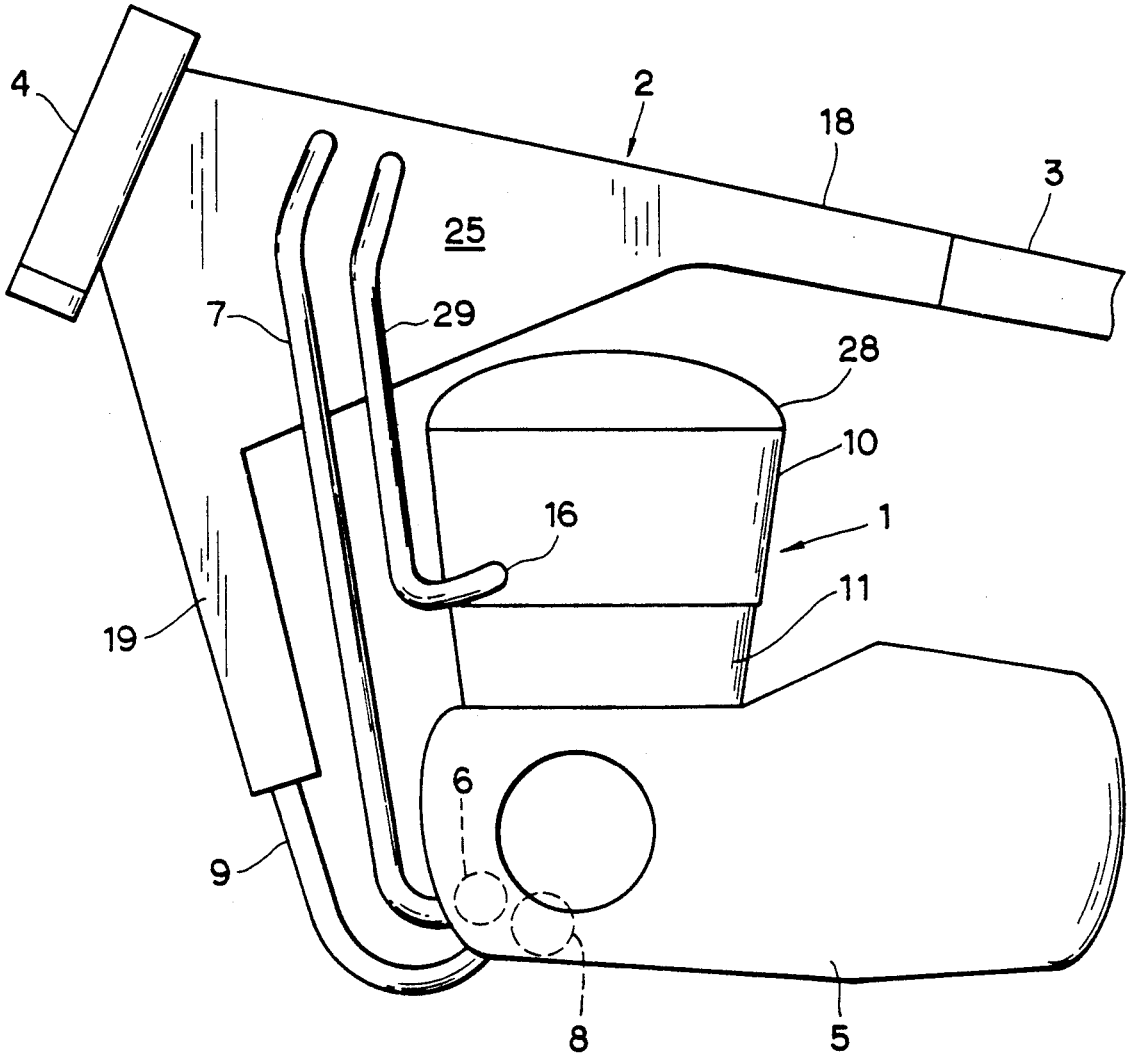
FIG. 5 is a side view similar to that shown in FIG. 3 showing a modification thereof according to the present invention.

FIG. 5 shows a side view similar to that of FIG. 3 and represents a modified embodiment of the engine cooling system according to the present invention, in which like reference numerals are added to members corresponding to those shown in FIGS. 2 to 4.

Referring to FIG. 5, a flowout pipe 29 is connected to the flowout port 16 of the cylinder head 10 and the flowout pipe 29 is directly connected to the main tube 18 constituting the oil tank 2. According to this embodiment, the engine oil after cooling the cylinder head 10 is directly guided into the oil tank 2 without passing the scavenge pipe 7. The functions and effects of this embodiment are substantially identical to those attained by the first embodiment described in conjunction with FIGS. 2 to 4.

Figure 6:
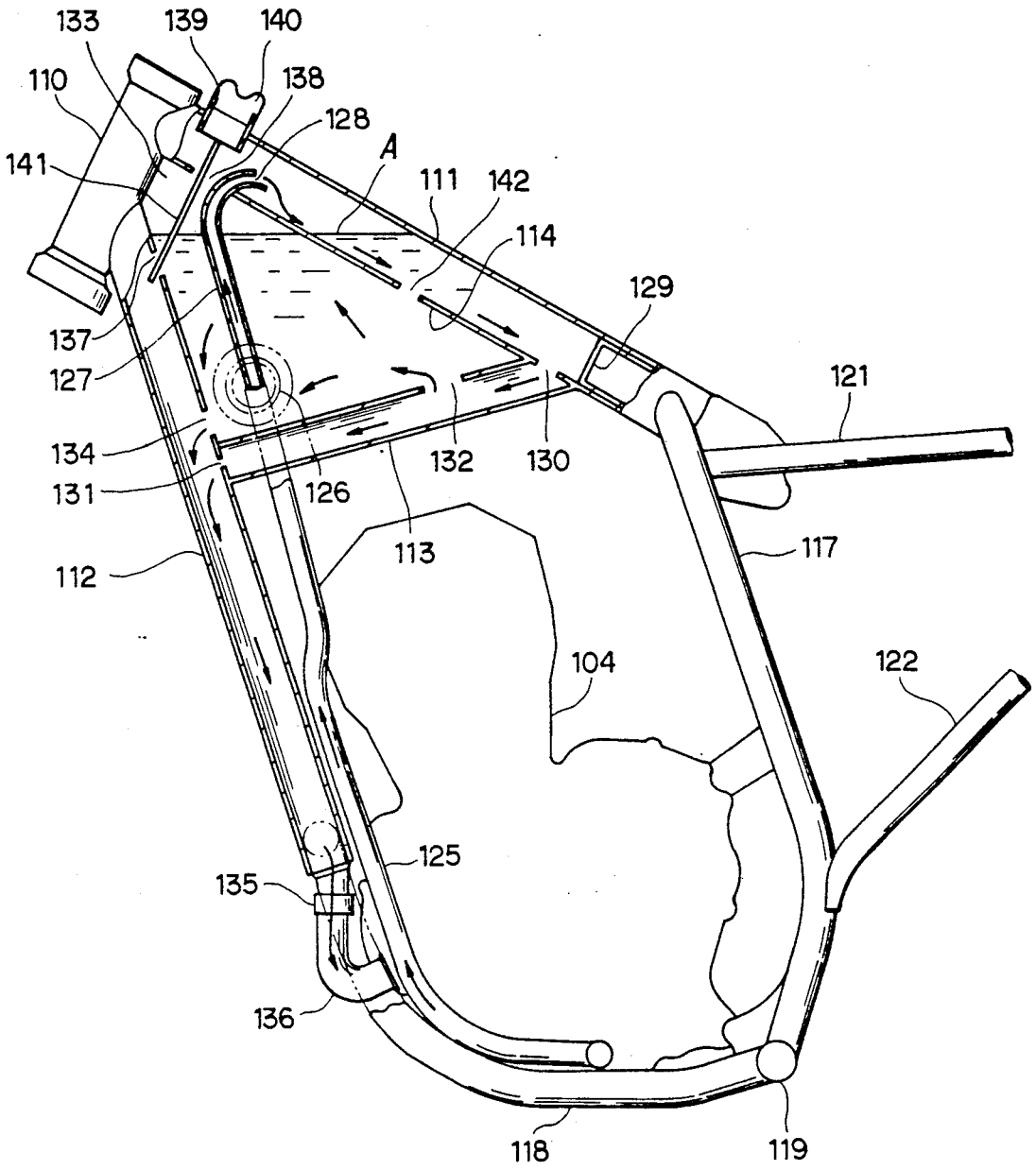
FIG. 6 is a side view of another embodiment of the engine cooling system utilizing an oil tank device according to the present invention.

According to another aspect of the present invention, in view of the bleeding of the air included in the engine oil for improving the engine cooling effect of the engine oil, there is provided an oil tank device having an improved structure with reference to FIG. 1 and FIG. 6. Referring to FIG. 6, a pair of bilateral body tubes 117 extends downwardly from the rear end of the maintube 111 (901) which may act as a tank rail and the body tubes 112 are connected to a pair of bilateral lower tubes 118 extending rearwardly from the lower portion of the down tube 112 (902) through a cross member 119. THe engine unit 104 (400) is mounted in a space defined by these pipe or tube members. The body tubes 117 are integrally provided with a pivot portion 120 to which a swing arm 300 is pivotally connected to be vertically swingable. Seat rail 121 extends rearwardly of the motorcycle body from the upper portions of the body tubes 117 and the seat rails 121 are reinforced by seat pillars 122 on which the seat 700 are arranged.

An oil pump, not shown, is disposed below the engine unit 104 and the engine oil drained by the oil pump flows upwardly through an oil hose 125 into an oil guide hose 127 connected to the oil hose 125 through a connecting portion 126. The engine oil is then fed into the main tube 111 through a port 128 formed in an upper portion of the guide hose 127. The engine oil including air introduced into the main tube 111 flows rearwardly downwardly in an oil passage formed inside the main tube 111 and abuts against a stopping member 129 arranged in the main tube 111. A first oil port 130 having an opening size for limiting an amount of flow of the engine oil into the bridge tube 113 is formed in the main tube 111 at a portion near the stopping member 129. According to the location of the first oil port 130 having the limited opening size, the engine oil including the air stays in the main tube 111 and the air is effectively separated from the oil. Accordingly, the engine oil containing a reduced amount of air is fed into the bridge tube 113 through the first oil port 130.

The engine oil introduced into the bridge tube 113 flows forwardly of the motorcycle body through an oil passage formed in the bridge tube 113.

The down tube 112 is provided with a second oil port 131 communicating with the oil passage of the bridge tube 113. The second oil port 131 has an opening size smaller than that of the first oil port 130 for limiting an oil amount to be fed into the down tube 112. Accordingly, the engine oil containing a reduced amount of air stays for a relatively long time in the bridge tube 113 and the air is effectively separated from the oil during the stay in the bridge tube 113, and the engine oil including substantially no air is fed into the down tube 112 through the second oil port 131. In a preferred embodiment, it will be desired that the opening size of the second port 131 is less than half the size of the opening of the first port 130. The bridge tube 113 is provided with a fourth port 132 at a portion apart from the second port 131 and near the first port 130 for draining the air separated and staying in the bridge tube 113 into the space constituting the oil tank 114, which is defined by the main tube 111, the down tube 112, the bridge tube 113 and a pair of bilateral frame members, not shown, covering the space. The air separated from the oil in the bridge tube 113 is introduced into the oil tank 114, moves upwardly therein and is stored in an air reservoir 133 formed at the upper portion of the oil tank 114, while further separating the air in the oil tank 114. The fourth port 132 may have an elongated slit shape.

The down tube 112 is further provided with a third oil port 134 at a portion near the second port 131 for introducing the oil containing a reduced amount of air in the oil tank 114 into the down tube 112. The oil passing the third port 134 is then fed downwardly in an oil passage formed in the down tube 112 together with the oil passing the second port 131 towards the lower portion of the down tube 112 while separating the slightly remaining air from the oil substantially completely. Thus, the oil having substantially no air is fed into the engine unit 104 through an oil passage joint member 135 and an oil feeding hose 136.

The down tube 112 is further provided with a fifth port 137 communicating with the oil tank 114 at the upper portion of the down tube 112 for introducing the air separated in the down tube 112 into the oil tank 114 and, hence, in the air reservoir 133. A sixth port 138 for draining the air which accumulates in the air reservoir 133 into an upper portion of the main tube 111 is formed in the main tube at a portion contacting to the air reservoir 133. An oil supply port 139 is formed in the front upper portion of the main tube 111 and oil supply cap 140 is fitted to the oil supply port 139. To the oil supply cap 140 is secured an oil level gauge 141 which is inserted into the oil through the sixth port 138 and the fifth port 137. Referring to FIG. 6, reference numeral 142 designates a seventh port for draining air in the oil tank 114 into the main tube 111 and a character A designates a top level of the oil in the oil tank 114.

According to this embodiment, the engine oil containing substantially no air can be fed into the engine unit 104, so that the mechanical loss of the components of the engine unit can be effectively eliminated and the generation of the noise of the oil pump, for example, can also be prevented. Moreover, the temperature and the pressure of the engine oil can be stabilized, whereby the circulation of the engine oil can be also stabilized. The overheating and seizing of the engine unit can be prevented, thus improving the engine cooling efficiency, and the durability of the components of the engine unit can be also improved.

In a more preferred embodiment, the respective ports 30, 31, 32, 33 and 34 of the engine cooling system of the embodiment shown in FIG. 2 may be formed so as to have structures as described with reference to the embodiment shown in FIG. 6 without applying any specific technique and, in other words, the pipe arrangement of the scavenge pipe 7 and the flowout pipe 17 of FIG. 2 may be also applied to the embodiment shown in FIG. 6.

What is claimed is:

1. A cooling system for cooling an engine unit equipped with a cylinder head and a crank case in which an oil feed pump and a scavenge pump are disposed, said cooling system comprising:

an oil tank constituted by a hollow main tube, a hollow down tube, a hollow bridge tube connecting said main tube and said down tube so as to communicate with each other through port means, and frame members covering a space defined by said main tube, said down tube and said bridge tube;

a feed pipe connecting said down tube to said feed pump;

a scavenge pipe connecting said oil tank to said scavenge pump; and a flowout pipe connecting said cylinder head to said oil tank, said flowout pipe being indirectly connected to said oil tank through said scavenge pipe.

2. A cooling system according to claim 1, wherein said scavenge pipe is connected in oil communication to said hollow main tube of the oil tank.

3. A cooling system for cooling an engine unit including an oil tank device, said oil tank device comprising:

a head pipe;

a hollow main tube extending downwardly from said head pipe;

a hollow down tube extending downwardly from said head pipe;

a hollow bridge tube connecting said main tube and said down tube; and frame members covering a space defined by said head pipe, said main tube, said down tube and said bridge tube, said main tube being provided with a first oil port communicating an interior of said main tube with an interior of said bridge tube, said down tube being provided with a second oil port communicating the interior of said bridge tube with an interior of said down tube, said first oil port having an opening size larger than that of said second oil port, said main tube being further provided with an oil port communicating the interior of said main tube with said space, said down tube being further provided with an oil port communicating the interior of said down tube with said space, said bridge tube being provided with an oil port communicating the interior of said bridge tube with said space.

4. A cooling system according to claim 3, wherein said oil port provided for said bridge tube is located apart from said second oil port and near said first oil port.

5. A cooling system according to claim 3, wherein said oil tank is further provided with an air reservoir disposed at an upper portion of said space.

6. A cooling system according to claim 5, wherein the down tube is further provided with a port communicating with said air reservoir.

7. An oil lubricating and cooling system for a motorcycle having an engine unit having a cylinder head and a crank case:

an oil tank for storing oil;

means including a feed pump disposed in the crank case for flowing a part of the oil from the oil tank to the engine unit for lubrication thereof and for flowing another part of the oil from the oil tank to the cylinder head for cooling thereof;

means including a scavenge pump disposed in the crank case for flowing oil that has drained to the crank case from the engine unit to the oil tank; and means for returning the oil used to cool the cylinder head directly to the oil tank without passing through the crank case.

8. An oil lubrication and cooling system according to claim 7; wherein the oil tank comprises a hollow main tube, a hollow down tube, a hollow bridge tube connecting the main tube and down tube so as to communicate with each other, and frame members on each side of and covering a space defined by the main tube, down tube and bridge tube.

9. An oil lubrication and cooling system according to claim 8; wherein the means for flowing oil from the oil tank includes a feed pipe connecting the down tube to the feed pump.

10. An oil lubrication and cooling system according to claim 9; wherein the means for flowing oil that has drained to the crank case includes a scavenge pipe connecting the oil tank to the scavenge pump.

11. An oil lubrication and cooling system according to claim 10; wherein the means for returning the oil used to cool the cylinder head directly to the oil tank comprises a flowout pipe connecting the cylinder head to the scavenge pipe.

12. An oil lubrication and cooling system according to claim 7; wherein the means for returning the oil used to cool the cylinder head directly to the oil tank comprises a flowout pipe connecting the cylinder head to the oil tank.

13. An oil lubrication and cooling system according to claim 10; including means in the oil tank defining an air reservoir located above the level of oil in the oil tank, and means for separating air contained in the oil to enable the separated air to flow to the air reservoir.

* * * * *